United States Patent [19]

Broersz

[11] Patent Number: 4,682,558

[45] Date of Patent: Jul. 28, 1987

[54] UNDERWATER SCOURING APPARATUS

[75] Inventor: Gerrit Broersz, Schoonhoven, Netherlands

[73] Assignee: John Meadè, United Kingdom

[21] Appl. No.: 784,172

[22] Filed: Oct. 4, 1985

[30] Foreign Application Priority Data

Oct. 6, 1984 [GB] United Kingdom ..... 8425322

[51] Int. Cl.[4] ..... B63B 59/06

[52] U.S. Cl. ..... 114/222; 15/1.7; 15/29; 15/49 R

[58] Field of Search ..... 114/222; 15/1.7, 29, 15/372, 49 R

[56] References Cited

U.S. PATENT DOCUMENTS 3,628,489 12/1971 Michaelsen ..... 114/222
3,781,937 1/1974 Jacobs ..... 15/49 R
4,052,950 10/1977 Hirata ..... 114/222
4,084,535 4/1978 Rees ..... 114/222
4,095,378 6/1978 Urakami ..... 114/222 X
4,319,434 3/1982 Brejcha ..... 15/49 R X

FOREIGN PATENT DOCUMENTS 2540753 8/1984 France ..... 114/222

*Primary Examiner*—Joseph F. Peters, Jr.
*Assistant Examiner*—Paul E. Salmon
*Attorney, Agent, or Firm*—Handal & Morofsky

[57] ABSTRACT

Underwater scouring apparatus comprises a flexible sheet (1), a plurality of rotatably drivable scouring tools (4, 5) secured to the sheet. The sheet may flex or twist in use allowing one of the tools to pass independent of the other tool over an irregularity in the surface being scoured. This enables the tool to clean efficiently around welds and rivets.

9 Claims, 4 Drawing Figures

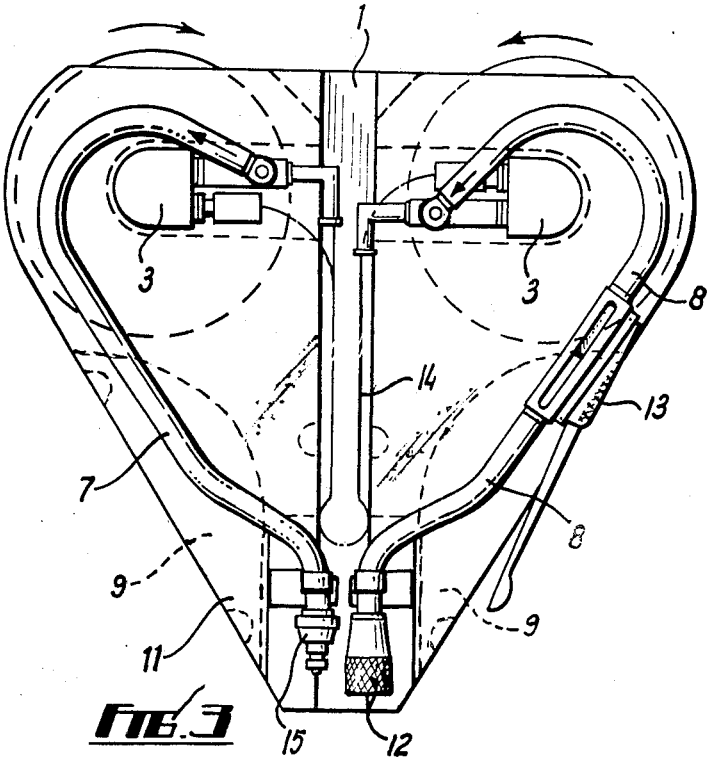
ГИБ. 3
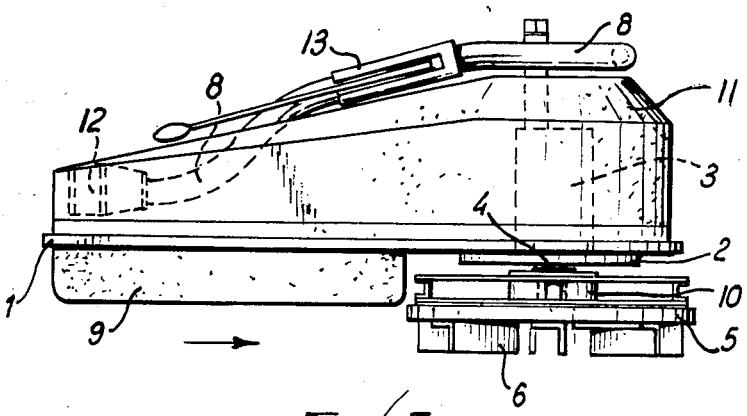
ГИБ. 4

UNDERWATER SCOURING APPARATUS

This invention relates to a scouring apparatus for underwater use, for example by a diver in the cleaning of metal, concrete or other surfaces. The invention finds application in the removal of barnacles and other accretions from ships' hulls, undersea pipelines, supports for offshore platforms and the like.

Previously known underwater scouring apparatus comprises a pair of contrarotating hydraulically driven scouring plates mounted on the respective supports, the supports being secured together by means of a hinge. Contrarotation of the plates serves to balance the forces created in use, facilitating easy manipulation by a diver.

According to the present invention underwater scouring apparatus comprises a flexible sheet, and a plurality of rotatably drivable scouring tools secured to the sheet.

The tools may be driven by respective hydraulic motors. The tools may comprise discs mounted with cutting blades, teeth, abrasive pads or other fixtures. The tool hearing discs may be replaced underwater by the operator.

A preferred apparatus adapted for manual use by a single diver comprises two tools arranged to rotate in opposite directions in use. The apparatus may comprise more than two tools.

Attachment of the tools to a flexible sheet confers advantages over the prior arrangement which incorporates hinges.

The sheet may flex or twist in use allowing one of the tools to pass independent of the other tool over an irregularity in the surface being scoured. This enables the tool to clean efficiently around welds and rivets. Twisting about the hinge of a prior art device was impossible, making it difficult to obtain access to surfaces adjacent to rivets welds or other irregularities.

A flexible sheet serves to damp vibrations within the apparatus, reducing stress and fatigue on a user. This is important when the user is a diver in order to maximize the work that may be done in the limited period a diver may remain underwater.

A flexible sheet is not prone to wear and corrsion to the same extent as a hinge. Furthermore a rubber or plastic sheet is cheaper to manufacture or replace. Hinges suffer from the disadvantage that debris produced by the tools may pass through the openings around the hinge, obscuring a user's vision and with the possibility of causing the hinge to seize.

In addition the suction of the apparatus to a work surface is enhanced by provision of a single flexible sheet rather than two separate plates connected by a hinge.

The flexible sheet may have a larger area than a hinged arrangement without recourse to a long and consequently expensive and delicate hinge. A large area is preferred to screen the user from the scouring tools. A large area of sheet also allows the provision of an outlet duct or channel for debris produced by the tool. There is also more room for attachment of bouyancy floats.

A preferred embodiment of this invention incorporates one or more pumps arranged to pump water away from the vicinity of the tools. The pump or pumps serve to create a force which tends to move the apparatus towards the work surface. This reduces the effort required of a user.

The pump may comprise a radial impeller attached to the spindle of each tool.

The invention is further described by means of example and not in any limitative sense with reference to the accompanying drawings, of which:

FIG. 3 is a schematic horizontal cross-section of the apparatus; and

FIG. 4 is a schematic vertical cross-section of the apparatus.

Figure 1:
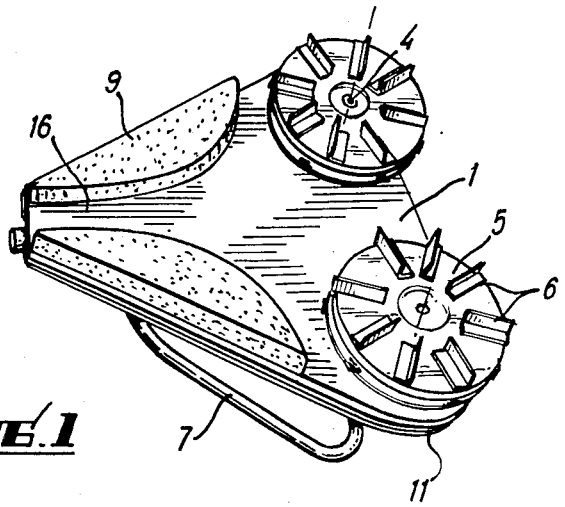
FIG. 1 is a perspective view of the working side of apparatus in accordance with the invention.
Figure 2:
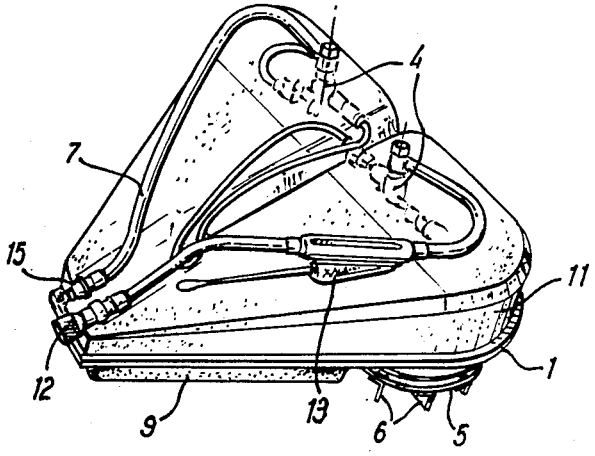
FIG 2 is a perspective view of the operator's side of the apparatus.

The Figures show an apparatus in accordance with this invention adapted for manual use by a single diver. The apparatus comprises a flexible sheet 1 composed of reinforced rubber although alternative flexible materials may be used e.g. plastics, fibre reinforced plastics or metal sheeting. For example Neoprene, Hypalon, polyurethane, polypropylene or polyethylene sheets may be reinforced with canvas fibres or woven gauze of Kevlar or Aramide or other textile or metal fibres. Two hydraulic motors 3 are secured by means of base plates 2 to the sheeting. A scouring tool attached to the drive shaft 4 of each motor 3, comprises a circular plate 5 carrying a plurality of blades 6. Alternative tools may comprise circular plates mounted with woven wire flails, brushes, teeth or abrasive pads. The blades or teeth may be arranged to act in use as an impeller to urge the apparatus towards a workpiece.

A pump comprising a radial impeller 10 is located behind the plate 5. Water drawn from the vicinity of the blades 6 is expelled radially outwardly by the impeller 10 creating a force which maintains the apparatus close to the workpiece with minimal expenditure of energy by the diver. The motors 3 are arranged to rotate in opposite directions so as to expel debris from the tools in a downward direction between the tools. Use of the impeller is advantageous in that any convenient tool may be employed without detriment to the suction of the apparatus towards the workpiece.

A pair of floatation blocks 11 are provided on the rear surface of the apparatus to provide a slightly negative bouyancy of the apparatus, for example a specific weight of 1.5. Additional floatation blocks 9 are provided on the front of the flexible sheeting. The blocks 9 are arranged in spaced apart relation to provide a central channel 16 for debris from the tools.

The hydraulic medium is supplied from an inlet 12 via a pipe 8, spring switch 13 to the first motor and hose 14 to the second motor. Spent medium is returned to the outlet 15 via a pipe 7. The pipes 7 and 8 are arranged to serve as handles for the apparatus, avoiding any need for provision of unnecessary hoses. The switch 13 serves to stop the supply of hydraulic medium if the diver's grip is released.

In use of the apparatus the flexible sheet 1 allows the apparatus to fold about the central axis. In addition and in distinction from prior arrangements which incorporate a hinge, the sheet may also flex in other directions.

I claim:

1. Underwater scouring apparatus comprising a flexible sheet, mounting means for supporting said flexible sheet, and a plurality of rotatably drivable scouring tools each mounted on said sheet for movement with said sheet, each tool moving independently with respect to one another, said sheet having sufficient flexibility to allow said sheet to conform to a surface of a workpiece and said mounting means being configured to allow said sheet to conform to said surfface of said workpiece and to allow said tools to independently pass over an irregularity in said surface of said workpiece in response to the application of pressure to said apparatus.

2. Apparatus as claimed in claim 1, wherein the sheet comprises reinforced rubber or plastics material.

3. Apparatus as claimed in claim 1 comprising two tools arranged to rotate in use in opposite directions.

4. Apparatus as claimed in claim 1 wherein each tool comprises a circular disc carrying scouring members selected from: flails, blades, teeth or abrasive pads.

5. Apparatus as claimed in claim 1, comprising one or more pumps adapted to pump water from the vicinity of the tools.

6. Apparatus as claimed in claim 5, wherein each pump comprises a radial impeller mounted on a drive shaft of a respective tool.

7. Apparatus as claimed in claim 1, including one or more floatation blocks secured to the sheet.

8. Apparatus as claimed in claim 7, where said floatation blocks are arranged to form a duct for debris from the tools.

9. Apparatus as claimed in claim 1, wherein hydraulic supply and return lines are arranged to form handles.

* * * * *